US008434199B1

(12) United States Patent
Bowen et al.

(10) Patent No.: US 8,434,199 B1
(45) Date of Patent: May 7, 2013

(54) COOKING DEVICE KNOB SAFETY ASSEMBLY

(75) Inventors: Cynthia L. Bowen, Washington, NC (US); Walter Lee Bowen, Washington, NC (US)

(73) Assignee: Kidkusion, Inc., Washington, NC (US)

( * ) Notice: Subject to any disclaimer, the term of this patent is extended or adjusted under 35 U.S.C. 154(b) by 0 days.

(21) Appl. No.: 13/278,295

(22) Filed: Oct. 21, 2011

(51) Int. Cl.
*G05G 1/06* (2006.01)

(52) U.S. Cl.
USPC ..... 16/441; 16/DIG. 30; 74/553; 126/42

(58) Field of Classification Search ..... 16/441, 16/431, 110.1, 414, 417, 433, DIG. 30; 74/553; 292/347–349; 40/331; 126/42, 39 N; 251/93, 251/96
See application file for complete search history.

(56) References Cited

U.S. PATENT DOCUMENTS 2,501,008 A * 3/1950 Schramm ..... 74/548
2,829,538 A * 4/1958 Mueller ..... 74/548
2,849,891 A * 9/1958 Mills ..... 74/504
4,253,690 A * 3/1981 Hollander ..... 292/354
4,300,525 A * 11/1981 Delgado et al. ..... 126/42
5,363,720 A * 11/1994 Sanchez ..... 74/553
5,741,003 A * 4/1998 Segien, Jr. ..... 251/95
5,771,878 A * 6/1998 Lewis et al. ..... 126/42
5,931,150 A * 8/1999 Bowen et al. ..... 126/42
6,375,150 B1 * 4/2002 Aguirre-Esponda et al. ... 251/96
6,394,081 B1 * 5/2002 Aguirre-Esponda et al. ... 126/42
7,963,003 B1 * 6/2011 Keene ..... 16/441

* cited by examiner

*Primary Examiner* — William L. Miller
(74) *Attorney, Agent, or Firm* — Coats & Bennett, P.L.L.C.

(57) ABSTRACT

A knob safety assembly is operative to selectively restrict depression of a cooking element control knob. The safety assembly includes a blocking plate disposed inside of a bezel assembly. The bezel assembly includes an outer bezel defining one or more angled camming surfaces, and an inner bezel. Rotation of the inner bezel with respect to the outer bezel about a rotational axis slides an ear of the blocking plate along the camming surface to effect movement of the blocking plate along the rotational axis between a raised position, in which the blocking plate restricts depression of a cooking element control knob, to a recessed position, in which the blocking plate facilitates depression of the control knob. The inner bezel is releasably locked from rotating with respect to the outer bezel, and engages the blocking plate to constrain the blocking plate against movement along the rotational axis when locked.

14 Claims, 4 Drawing Sheets

COOKING DEVICE KNOB SAFETY ASSEMBLY

BACKGROUND

The present invention generally relates to knob safety devices, and more particularly relates to a knob safety assembly for preventing children from activating a cooking element.

A common concern among parents is preventing children from playing with hazardous household items such as cooking devices, electrical outlets, and cupboard contents to prevent children from exposing themselves to potentially harmful conditions. Although electrical outlets and cupboards may be positioned to be out of reach of children, cooking devices, such as a stove, are generally low to the ground and easily reachable, and are therefore of particular concern. Numerous prior art safety devices for cooking devices have been proposed; however, many of the prior art devices have proven easily circumvented or cumbersome to use. One of the better prior art devices is shown in U.S. Pat. No. 5,931,150. However, the device of the '150 patent must be removed in order for the knob to be actuated, and then replaced when done, which has proven less than desirable in some situations. As such, there remains a need for alternative designs of stove knob safety devices.

SUMMARY

A knob safety assembly is operative to restrict depression of a cooking element control knob. The knob safety assembly includes a bezel assembly and a blocking plate that is disposed inside of the bezel assembly, with the blocking plate movable relative to the bezel assembly between raised and recessed positions. When the blocking plate is in the raised position, the blocking plate restricts depression of the corresponding cooking element control knob; when the blocking plate is in recessed position, the blocking plate allows depression of the control knob. The bezel assembly includes an outer bezel defining one or more angled camming surfaces, and also an inner bezel. Rotation of the inner bezel with respect to the outer bezel about a rotational axis slides an ear of the blocking plate along the camming surface to effect displacement of the blocking plate along the rotational axis. The inner bezel is releasably locked from rotating with respect to the outer bezel, and the inner bezel engages the blocking plate to constrain the blocking plate against movement along the rotational axis when the inner bezel is rotationally locked with respect to the outer bezel. A cooking device utilizing the knob safety assembly is also disclosed.

Of course, the present invention is not limited to the above features and advantages. Indeed, those skilled in the art will recognize additional features and advantages upon reading the following detailed description, and upon viewing the accompanying drawings.

DETAILED DESCRIPTION

Figure 1:
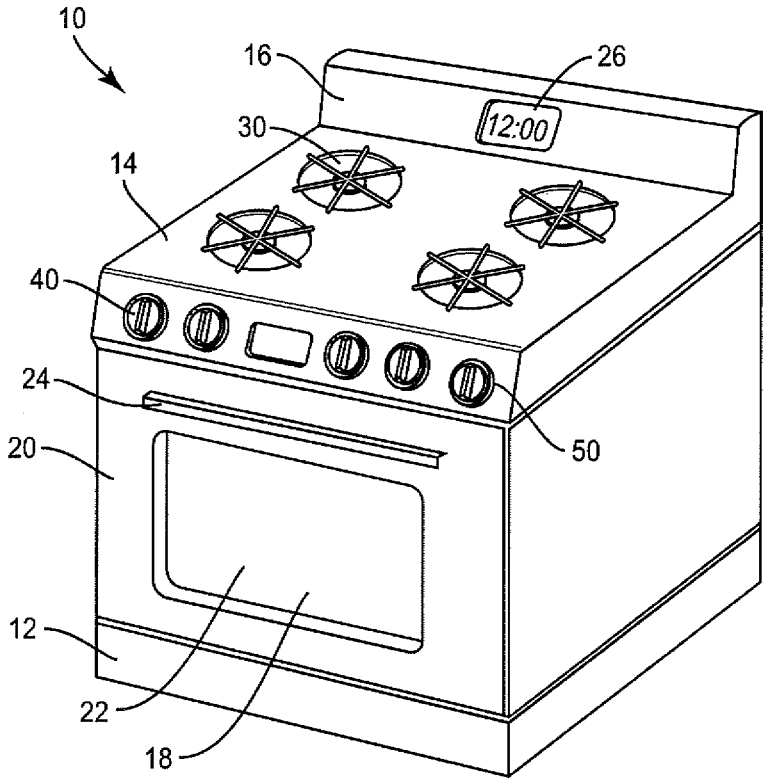
FIG. 1 is a perspective view of a cooking device having a plurality of cooking elements and associated control knobs.

As will be discussed in greater detail below, a knob safety assembly 50 is operative to restrict depression of a cooking element control knob 40 of a cooking device (e.g., stove 10). The knob safety assembly 50 includes a bezel assembly 51 and a blocking plate 56 that is movable relative to the bezel assembly 51 between a raised or "blocking" position, in which the blocking plate 56 restricts depression of the control knob 40, and a recessed or "retracted" position, in which the blocking plate 56 allows depression of the control knob 40. Although the knob safety assembly 50 is discussed in connection with a stove 10, it is understood that the stove 10 is only an example cooking device, and that the knob safety assembly 50 is applicable to a wide variety of cooking devices, such as griddles and the like, and other non-cooking devices having similar push-in type control knobs.

Referring to FIG. 1, the stove 10 has a generally rectangular shape, an oven 18 in a lower portion, and a plurality of stovetop cooking elements 30 arrayed on its top surface 14. The oven 18 may be accessed via its door 20 by pulling on the appropriate handle 24, and may be viewed via a door window 22. Along the back edge of the top surface 14 is a splatter shield 16, which may optionally include a clock 26. The cooking elements within the oven 18 and the stovetop cooking elements 30 may be electrically powered, may be gas fired, or a combination of both, for example. Further, as is known in the art, the oven 18 may include microwave radiation sources for additional or alternative methods of cooking.

Figure 2:
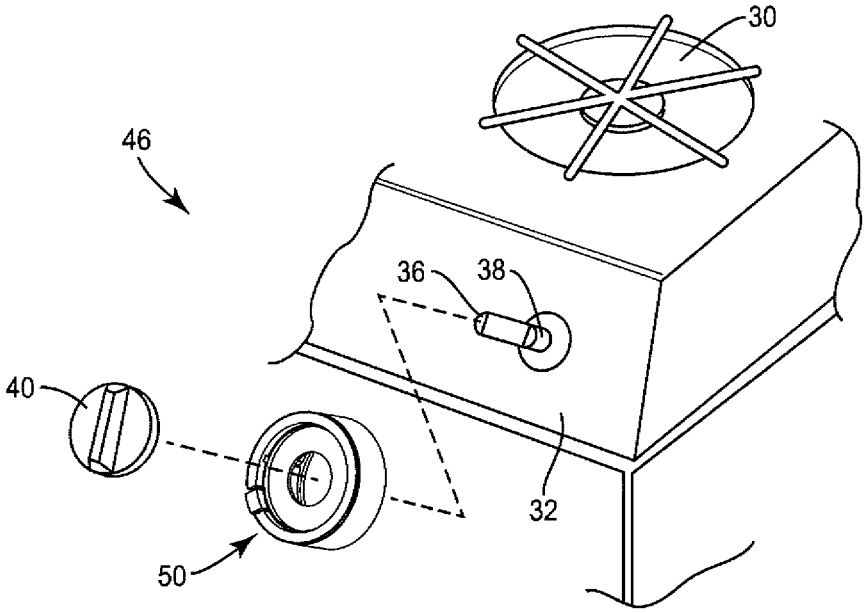
FIG. 2 is a perspective partial exploded view of a cooking device knob assembly.
Figure 5:
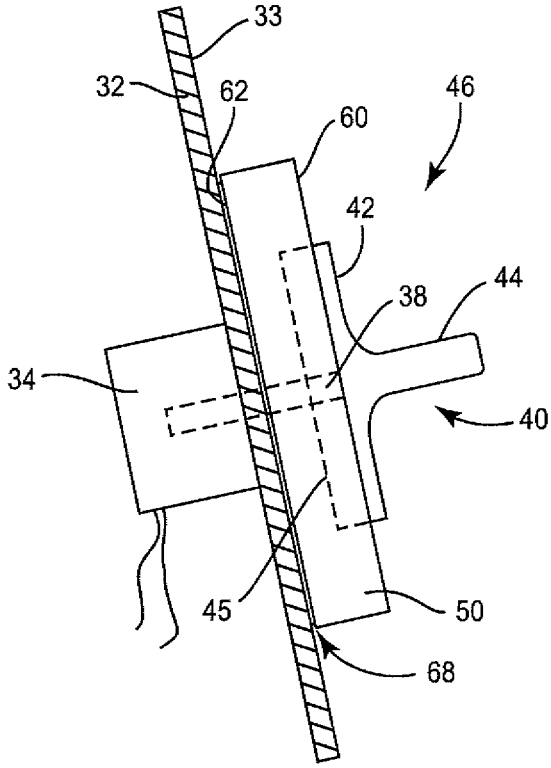
FIG. 5 is a side section view of the knob safety assembly and associated knob and switch.

Referring to FIGS. 2 and 5, the stove 10 typically includes a control panel 32 arranged either on its front surface 12 or along its top surface 14. The control panel 32 may be angled or coplanar with respect to its associated surface 12 or 14. The control panel 32 includes a plurality of control knobs 40 for activating and/or adjusting the cooking elements 30. These control knobs 40 typically have a generally round base portion 42 and have a gripping flange 44 extending out normally thereto. A rear face 45 of the base portion 42 is typically flat. Each control knob 40 is attached to an external end portion 36 of its respective switch post 38, and may be attached in a keyed arrangement.

Each control knob 40 has an associated switch 34. The switch 34 is disposed mostly behind control panel 32 for safety reasons and attached thereto via brackets or the like. The switch post 38 of switch extends through a corresponding hole in control panel 32. By pressing and turning the switch post 38, via control knob 40, an operator is able to make the necessary adjustments to the cooking elements 30 via the switch 34 (e.g., adjusting an intensity of a respective cooking element 32).

To operate the stove 10, a user would turn control knobs 40 on the control panel 32 associated with the stove 10. In order to be able to turn the control knobs 40 from an "off" position, it is necessary to first push the control knob 40 (and consequently switch post 38) inwardly from an "out" position to an "in" position, before turning the control knob 40. Thus, a user needs to push in on the control knob 40 before it can be turned. By pushing in and twisting the control knob 40, the user is able to turn on the associated switch 34 and therefore activate one or more associated cooking elements 30. Additional details of the construction and operation of the stove 10, and variations thereof, are well known in the art and are not discussed further herein except as to assist in understanding the present invention.

The stove 10 includes one or more a cooking device knob assemblies 46 that each include a switch 34 (with its switch post 38 and control knob 40) and a knob safety assembly 50. The knob safety assembly 50 is disposed between the control knob 40 and the face 33 of control panel 32 (see FIG. 2). Advantageously, the knob safety assembly 50 substantially or fully surrounds the control knob 40 (see FIG. 5).

Figure 3A:
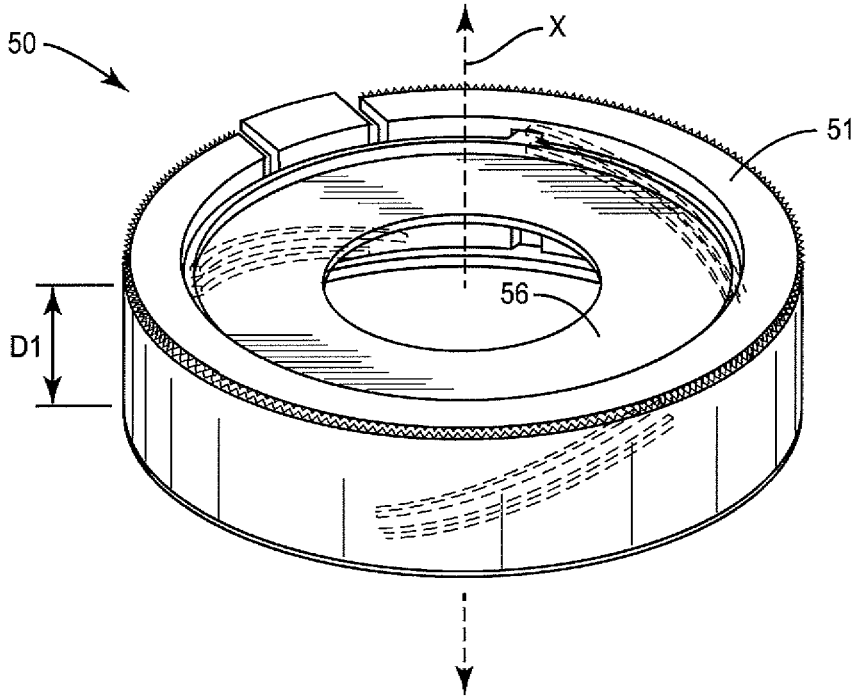
FIG. 3*a* is a view of a knob safety assembly having its blocking member in a blocking position.
Figure 3B:
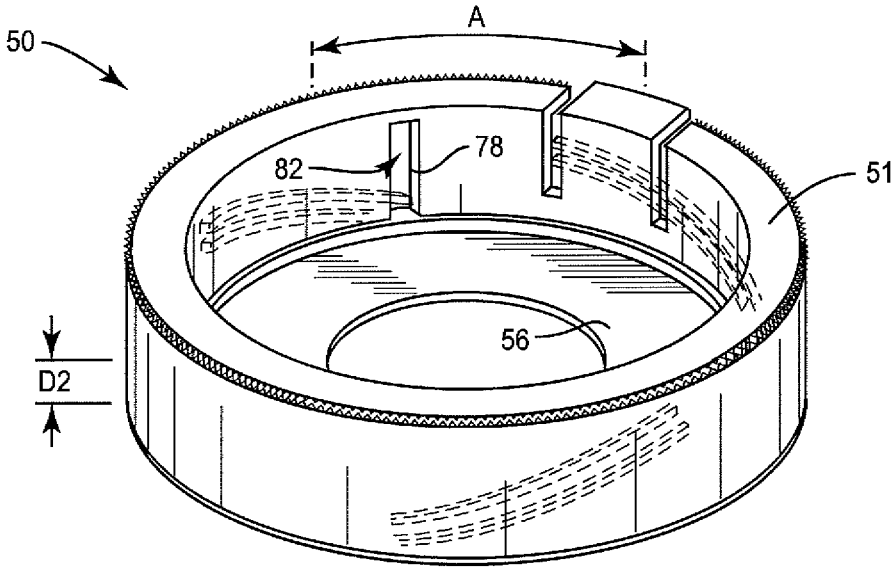
FIG. 3*b* is a view of the knob safety assembly having its blocking member in a retracted position.
Figure 4:
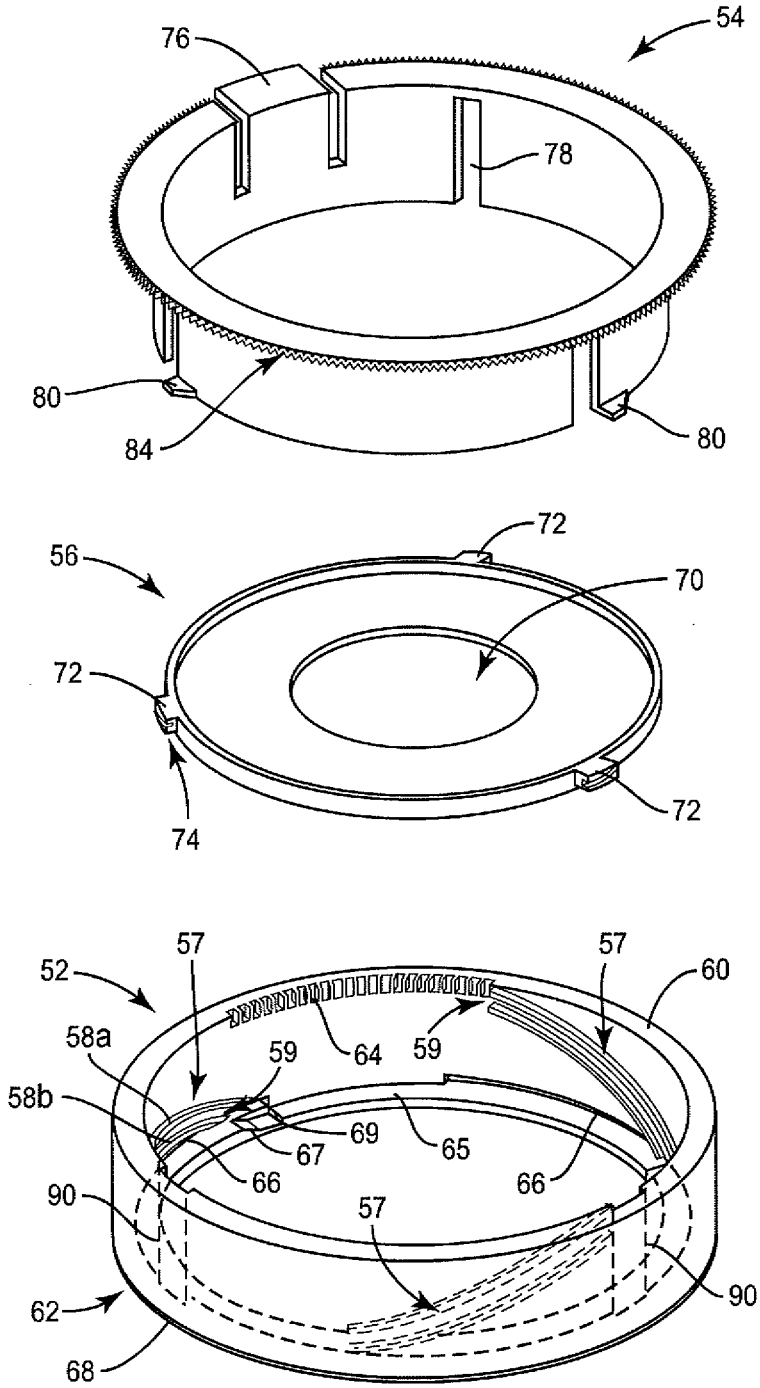
FIG. 4 is an exploded view of the knob safety assembly.

In general, the knob safety assembly 50 includes a bezel assembly 51 and a blocking plate 56 (see FIGS. 3-4). The bezel assembly 51 includes an outer bezel 52 and an inner bezel 54 rotatably mounted to the outer bezel 52. The outer bezel 52 may include a plurality of teeth 64 that rotationally lock the inner bezel 54 with respect to the outer bezel 52. The outer bezel 52 has a front face 60 and a rear face 62, and may include an adhesive layer 68 on the rear face 62 for anchoring the bezel assembly 51 to control panel 32. The sidewall of outer bezel 52 includes a plurality of camming surfaces 57 that are angled with respect to the rear face 62 and help control the motion of the blocking plate 56, as discussed further below. Each of the angled camming surfaces 57 advantageously includes a first rib 58*a*, and may optionally include a second spaced apart rib 58*b* defining a channel 59 therebetween. If both ribs 58*a-b* are included for each camming surface 57, a portion of blocking plate 56 rides in the channel 59, as discussed below. Otherwise, if only a single rib 58*a* is included in each camming surface 57, the outer bezel 52 does not define the channel 59.

The sidewall also advantageously includes a least one peripheral groove 66 that extends peripherally (e.g., circumferentially) around the central axis X of the outer bezel 52. These grooves 66 extend into the sidewall proximate rear flange 65 and the corresponding ribs 58*a-b*, and extend across an arc of limited extent. The end of the grooves 66 may advantageously include a ramp 67 that may be used to guide ears 72 of blocking plate 56, as discussed further below. The ramps 67 are advantageously angled at the same angle relative to rear face 62 as the corresponding camming surfaces 57. A depression 69 may optionally be located at one end of the groove 66 proximate the ramp 67.

The inner bezel 54 is disposed at least partially inside the outer bezel 52, and is rotatably coupled to the outer bezel 52 for rotation about rotational axis X that is parallel to, or coaxial with, the switch post 38. The inner bezel 54 includes at least one tongue 80, and each tongue 80 is received into a respective peripheral groove 66 in the sidewall of outer bezel 52. The inter-engagement of tongues 80 and grooves 66 mates the inner bezel 54 to the outer bezel 52, but allows relative rotation therebetween, and may also define the range of rotation of the inner bezel 54 with respect to the outer bezel 52 (see arc A of FIG. 3*b*).

The sidewall of outer bezel 52 also optionally includes one or more inwardly open channels 90 extending generally parallel to axis X. The optional channels 90 may be positioned to accept the tongues 80 and guide them to their respective grooves 66, for some or all of the tongues 80, during assembly of the inner bezel 54 to the outer bezel 52. The inner bezel 54 also advantageously includes a flexible moveable tab 76 that selectively disengages from teeth 64 to selectively rotationally unlock the inner bezel 54 from the outer bezel 52.

The outer bezel 52 and inner bezel 54 collectively define an annular cavity 82 within the bezel assembly 51 that houses the angled camming surfaces 57, tongues 80, and peripheral grooves 66. Axial slots 78 of the inner bezel 76 provide openings into the cavity 82, and the inner bezel 54 engages the blocking plate 56 via the axial slots 78. The inner bezel 54 may optionally include a circumferential gripping surface 84.

Figure 6:
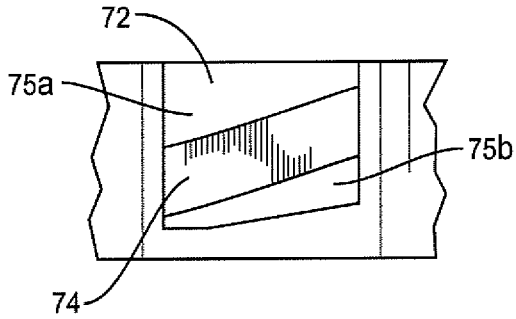
FIG. 6 is a view of a blocking plate ear of the knob safety assembly.

The blocking plate 56 is disposed inside of and is advantageously circumferentially surrounded by the bezel assembly 51. The blocking plate 56 has a central opening 70 to receive switch post 38 and also has a plurality of outwardly extending ears 72. Each of the ears 72 extends through a respective axial slot 78 of the inner bezel 54 to engage a respective one of the camming surfaces 57. Each of the ears 72 may include ear flanges 75*a-b* that define an ear slot 74 (see FIG. 6). One of the ribs 58 (e.g., the first rib 58*a*) of each angled camming surface 57 is received into the ear slot 74 of its corresponding ear 72. If the second rib 58*b* is included for each camming surface 57, another of the ribs (e.g., the second rib 58*b*) abuts a top or a bottom of its corresponding ear (i.e., by abutting one of the ear flanges 75*a-b*) such that a portion of each ear 72 is received into the channel 59 defined by the ribs 58*a-b*. Ear slots 74 are advantageously angled at the same angle as ribs 58*a-b*.

Each of the plurality of ears 72 is in sliding abutment with a respective one of the angled camming surfaces 57. As discussed above, the outer bezel 52 includes a plurality of teeth 64 that engage with a movable tab 76 of the inner bezel 54 to restrict rotation of the inner bezel 54. When the tab 76 engages the teeth 64, the inner bezel 54 is rotationally locked with respect to the outer bezel 52, and the slots 78 constrain the blocking plate 56 against axial or rotational movement. Tab 76 is movable to selectively rotationally unlock the inner bezel 54 from the outer bezel 52 by disengaging from the teeth 64. When the inner bezel 54 is unlocked and rotates with respect to the outer bezel 52 (by the operator), the slots 78 advance the ears 72 of the blocking plate 56 along their respective camming surfaces 57 to effect axial translational movement of the blocking plate 56 along the rotational axis X, due to the rotational movement of the blocking plate 56, between the blocking position (see FIG. 3*a*) and retracted position (see FIG. 3*b*). As can be appreciated, ramps 67 may help guide the ears 72 onto one of the ribs 58*a-b* when the blocking plate 56 is rotated from the fully retracted position toward the blocking position.

In the blocking position, the blocking plate 56 restricts depression of the control knob 40, and thus switch post 38, to prevent children from undesirably turning on the cooking elements 30. The blocking plate 56 is spaced apart from the rear face 62 of the outer bezel 52 (and the control panel 32 of the stove 10) by a distance D1 in the blocking position. Conversely, in the retracted position, the blocking plate 56 is spaced apart from the rear face 62 of the outer bezel 52 (and the control panel 32 of the stove 10) by a distance D2, which is less than the distance D1, thereby allowing depression of the control knob 40 and the switch post 38. The blocking plate 56 is also movable to a plurality of intermediate positions between the illustrated blocking and retracted positions. In the intermediate position the blocking plate 56 is spaced apart from the rear face 62 by a distance within a range defined by D1-D2.

In the example of FIGS. 3-4, the knob safety assembly 50 is illustrated as including three each of the angled camming surfaces 57, blocking plate ears 72, axial slots 78, tongues 80, and peripheral grooves 66. However, it should be understood that other quantities of these items could be included in the knob safety assembly 50. For example, the quantity of tongues 80 and corresponding peripheral grooves 66 may be less than the quantity of camming surfaces 57, ears 72 and slots 78. Also, although each of the inner bezel 54 and the outer bezel 52 are illustrated as having a cylindrical shape, other shapes, such as oval or rectangular, are possible.

The knob safety assembly 50 is advantageously formed of a suitable plastic material such as polycarbonate. The knob safety assembly 50 may be constructed so as to be generally translucent or transparent, or may be opaque, or a mix thereof, as is desired. Further, the knob safety assembly may optionally be colored, in whole or part, such as to match a color of the stove 10 for example.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A knob safety assembly operative to restrict depression of a control knob of a cooking device, the assembly comprising:

a bezel assembly comprising:

an outer bezel defining a first angled camming surface and having and a rear face;

an inner bezel disposed partially inside the outer bezel and rotatably coupled thereto for rotation about a rotational axis;

wherein the inner bezel is selectively lockable against rotation with respect to the outer bezel;

a blocking plate disposed inside the bezel assembly;

wherein the blocking plate has an opening to receive a switch post of a cooking element control knob and has a first ear in sliding abutment with the first camming surface;

wherein rotation of the inner bezel with respect to the outer bezel slides the first ear along the first camming surface to effect displacement of the blocking plate along the rotational axis between a raised position in which the blocking plate is further from the rear face to restrict depression of the control knob, to a recessed position in which the blocking plate is closer to the rear face to facilitate depression of the control knob;

wherein the inner bezel engages the blocking plate to constrain the blocking plate against displacement along the rotational axis when the inner bezel is rotationally locked with respect to the outer bezel.

2. The knob safety assembly of claim 1 wherein the outer bezel includes a plurality of teeth that engage with a movable tab of the inner bezel to restrict rotation of the inner bezel; wherein the tab is movable to selectively rotationally unlock the inner bezel from the outer bezel.

3. The knob safety assembly of claim 1 wherein the first camming surface includes a pair of spaced apart first and second ribs defining a channel therebetween; wherein the first rib is received into a slot of the first ear and the second rib abuts a top or a bottom of the first ear.

4. The knob safety assembly of claim 1 wherein the outer bezel and inner bezel define an annular cavity housing the first camming surface, and wherein the inner bezel includes a first slot providing a radial opening into the cavity; wherein the first ear extends through the slot to engage the first camming surface.

5. The knob safety assembly of claim 1 wherein the inner bezel includes one or more tongues, each tongue being received into a respective groove in the outer bezel; wherein the tongues and grooves jointly define a range of rotation of the inner bezel with respect to the outer bezel.

6. The knob safety assembly of claim 1 wherein each of the inner bezel and the outer bezel have a cylindrical shape; wherein the bezel assembly entirely circumferentially surrounds the blocking plate.

7. The knob safety assembly of claim 1:

wherein the first angled camming surface is one of three angled camming surfaces defined by the outer bezel; and wherein the blocking plate includes three blocking plate ears, each in sliding abutment with a different one of the three angled camming surfaces.

8. The knob safety assembly of claim 1 wherein the outer bezel has an adhesive layer on its rear face for anchoring the bezel assembly.

9. The knob safety assembly of claim 1 wherein the knob safety assembly is generally translucent.

10. A cooking device having at least one cooking element, at least one control panel having a panel face, and a cooking device knob assembly; the cooking device knob assembly comprising:

a switch for controlling an associated cooking element; the switch comprising:

a switch post extending through a hole in the panel face and moveable generally perpendicular to the panel face of the control panel between an in position and an out position; wherein the associated cooking element is not activated when the switch post is in the out position;

a control knob attached to an external end of the switch post; the control knob having a rear face generally parallel to the panel face of the control panel;

a knob lock safety device positioned between the control knob rear face and the panel face of the control panel and operative to restrict movement of the control knob and the switch post generally perpendicular to the panel face;

the knob lock safety device comprising:

a bezel assembly comprising:

an outer bezel defining a first angled camming surface;

an inner bezel disposed partially inside the outer bezel and rotatably coupled thereto for rotation about a rotational axis that is parallel to the switch post;

wherein the inner bezel is selectively lockable against rotation with respect to the outer bezel;

a blocking plate disposed inside of the bezel assembly and having an opening therethrough; the switch post extending through the opening;

the blocking plate further having a first ear in sliding abutment with the first camming surface;

wherein rotation of the inner bezel with respect to the outer bezel slides the first ear along the first camming surface to effect displacement of the blocking plate along the rotational axis between a raised position in which the blocking plate is further from the panel face to restrict depression of the control knob toward the panel face, to a recessed position in which the blocking plate is closer to the panel face to allow depression of the control knob toward the panel face;

wherein the inner bezel engages the blocking plate to constrain the blocking plate against displacement along the rotational axis when the inner bezel is rotationally locked with respect to the outer bezel.

11. The cooking device knob assembly of claim 10 wherein the outer bezel includes a plurality of teeth that engage with a movable tab of the inner bezel to restrict rotation of the inner bezel; wherein the tab is movable to selectively rotationally unlock the inner bezel from the outer bezel.

12. The cooking device knob assembly of claim 10 wherein the outer bezel and inner bezel define an annular cavity housing the first camming surface, and wherein the inner bezel includes a first slot providing a radial opening into the cavity; wherein the first ear extends through the slot to engage the first camming surface.

13. The cooking device knob of claim 10 wherein the inner bezel includes one or more tongues, each tongue being received into a respective groove in the outer bezel; wherein the tongues and grooves jointly define a range of rotation of the inner bezel with respect to the outer bezel.

14. The cooking device knob assembly of claim 10 wherein the rear face of the outer bezel is adhesively affixed to the panel face of the cooking device.

* * * * *